US005802907A

United States Patent [19]

Stodd

[11] Patent Number: 5,802,907

[45] Date of Patent: Sep. 8, 1998

[54] TOOLING APPARATUS AND METHOD FOR HIGH SPEED PRODUCTION OF DRAWN METAL CUP-LIKE ARTICLES

[76] Inventor: Ralph P. Stodd, 6450 Poe Ave., Suite 113, Dayton, Ohio 45414

[21] Appl. No.: 810,531

[22] Filed: Mar. 3, 1997

Related U.S. Application Data

[63] Continuation-in-part of Ser. No. 679,770, Jul. 15, 1996, which is a continuation-in-part of Ser. No. 516,831, Aug. 18, 1995, Pat. No. 5,638,717, which is a continuation-in-part of Ser. No. 184,969, Jan. 21, 1994, Pat. No. 5,442,947, which is a continuation-in-part of Ser. No. 30,777, Mar. 12, 1993, abandoned.

[51] Int. Cl.[6] ..... B21D 28/02

[52] U.S. Cl. ..... 72/336; 72/351; 72/404; 83/50

[58] Field of Search ..... 72/336, 337, 338, 72/329–331, 404, 347; 83/50, 687, 691

[56] References Cited

U.S. PATENT DOCUMENTS

| | | | |
|---|---|---|---|
| 1,439,393 | 12/1922 | Assmann | 83/50 |
| 1,932,407 | 10/1933 | Hothersall | 72/337 |
| 2,307,889 | 1/1943 | Korsgaard | 83/50 |
| 2,411,503 | 11/1946 | Calleson | 72/336 |
| 3,115,678 | 12/1963 | Keen | 72/350 |
| 3,194,047 | 7/1965 | Eggert | 72/349 |
| 3,196,817 | 7/1965 | Fraze | 29/430 |
| 3,251,319 | 5/1966 | Kaupert | 72/349 |
| 3,557,599 | 1/1971 | Eickenhorst | 72/404 |
| 3,695,088 | 10/1972 | Alvi | 72/405 |
| 3,855,862 | 12/1974 | Moller | 72/349 |
| 3,924,437 | 12/1975 | Hortig | 72/249 |
| 4,020,670 | 5/1977 | Bulso | 72/349 |
| 4,248,076 | 2/1981 | Bulso | 72/349 |
| 4,289,014 | 9/1981 | Maeder | 72/348 |
| 4,416,140 | 11/1983 | Bulso | 72/347 |
| 4,471,644 | 9/1984 | Kimbell | 72/449 |
| 4,550,588 | 11/1985 | Abe | 72/441 |
| 4,615,204 | 10/1986 | Yamamoto | 72/347 |
| 4,715,208 | 12/1987 | Bulso | 72/336 |
| 4,732,031 | 3/1988 | Bulso | 72/348 |
| 4,977,772 | 12/1990 | Bulso | 72/336 |
| 5,016,463 | 5/1991 | Johansson | 72/348 |
| 5,024,077 | 6/1991 | Bulso | 72/348 |
| 5,069,057 | 12/1991 | Lee | 72/404 |
| 5,140,879 | 8/1992 | Haj-Ali-Ahmadi | 83/50 |
| 5,272,902 | 12/1993 | Kobak | 72/348 |
| 5,394,727 | 3/1995 | Diekhoff | 72/348 |

FOREIGN PATENT DOCUMENTS

| | | | |
|---|---|---|---|
| 58927 | 4/1982 | Japan | 72/337 |

OTHER PUBLICATIONS

Loeffel, Emil, "Segment Rings Save Strip", from Metalworking Production, pp. 46–49, May 29, 1963.

*Primary Examiner*—Daniel C. Crane
*Attorney, Agent, or Firm*—Jacox, Meckstroth & Jenkins

[57] ABSTRACT

The dynamic loading on a double action high speed mechanical cupping press is substantially reduced with sets of tooling at multiple stages which forms a batch of cups from a strip of sheet metal with each stroke of the press. The tooling stages are positioned at predetermined stepped elevations and are arranged so that they sequentially blank the sheet metal to form a series of nested and out-of-round or contoured blanks. The tooling stages also sequentially hold the blanks and sequentially draw the blanks into cups. The tooling stages are symmetrically positioned with respect to the press center line, and each tooling set may also include a bottom panel punch surrounded by a pressure sleeve for sequentially forming a preform boss within the bottom wall of each cup.

23 Claims, 8 Drawing Sheets

FIG-5
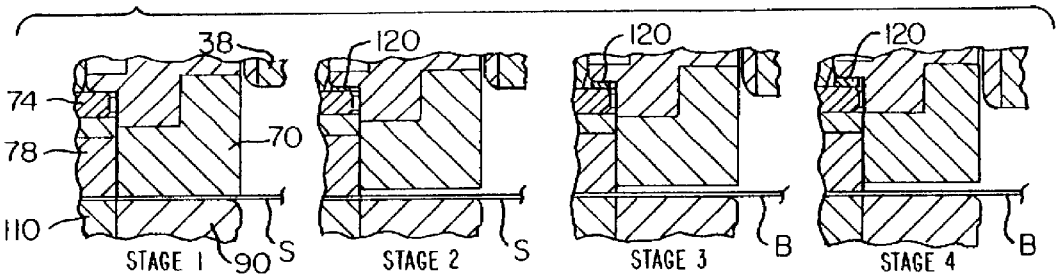
FIG-6
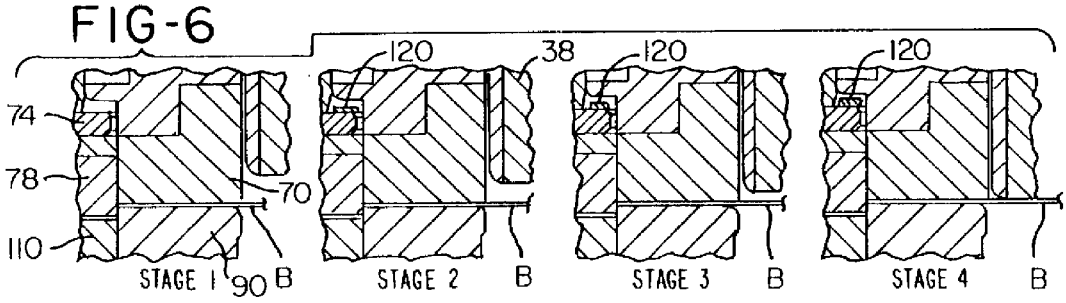
FIG-7
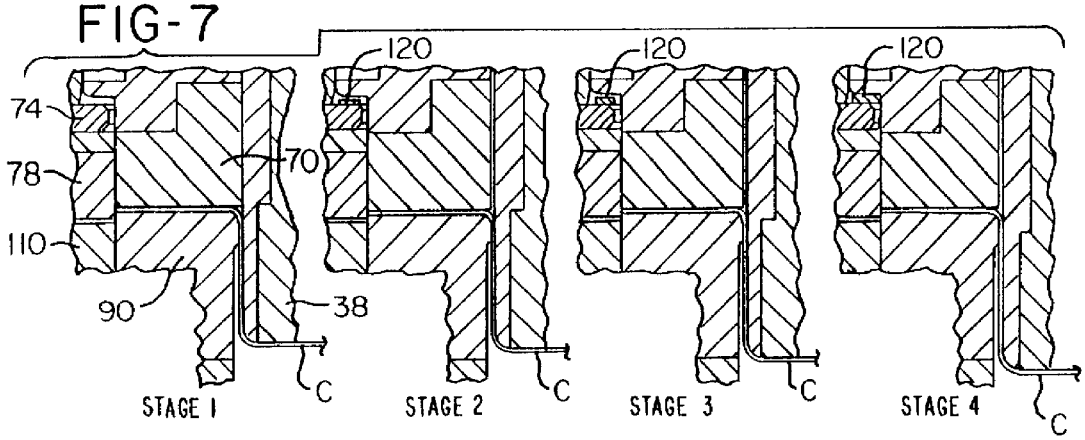
FIG-8
| DESCRIPTION | STAGE 1 | STAGE 2 | STAGE 3 | STAGE 4 |
|---|---|---|---|---|
| POCKETS | 1, 2, 13 & 14 | 3, 4, 11 & 12 | 5, 6, 9 & 10 | 7 & 8 |
| BLANK & DRAW RETAINERS | DOWN .012" | DOWN .012" | EVEN | EVEN |
| DRAW PAD SHIMS 120 | EVEN | UP .020" | UP .052" | UP .072" |
| UPPER PISTON SHIMS 121 | EVEN | UP .020" | UP .052" | UP .072" |
| DIE CENTER PUNCH SHIMS 122 | EVEN | DOWN .060" | DOWN .116" | DOWN .198 |

TOOLING APPARATUS AND METHOD FOR HIGH SPEED PRODUCTION OF DRAWN METAL CUP-LIKE ARTICLES

RELATED APPLICATION

This application is a continuation-in-part of application Ser. No. 08/679,770, Filed Jul. 15, 1996, which is a continuation-in-part of application Ser. No. 08/516,831, filed Aug. 18, 1995, U.S. Pat. No. 5,638,717, which is a continuation-in-part of application Ser. No. 08/184,969, filed Jan. 21, 1994, U.S. Pat. No. 5,442,947, which is a continuation-in-part of application Ser. No. 08/030,777, filed Mar. 12, 1993, abandoned.

BACKGROUND OF THE INVENTION

In the production of cups or cans in the can industry, it is common to use a double action mechanical press equipped with cupping tooling, for example, of the general type disclosed in U.S. Pat. Nos. 4,020,670, 4,248,076 and 4,416, 140. Such cupping presses commonly operate within a range of 150 to 200 strokes per minute (spm) and have a plurality of cup-forming tooling components in order to produce a batch of cups with each stroke of the press.

It has been found desirable to operate such a cupping press at a higher speed, for example, within a range of 220 to 250 spm, in order to meet the increase in production requirements in the can industry. However, such a substantial increase in the speed of the cupping press significantly increases the dynamic loading on the press, and especially the compressive and tensile loads on the outer ram of the double action press. This increase in dynamic loading on the press can result in the press exceeding its rated loading and failure of the press components.

It is known in the tool and die industry to construct punch and die tooling for blanking or cutting a plurality of parts from a sheet metal workpiece with each stroke of the press and by positioning each punch at a slightly different elevation corresponding to the thickness of the sheet metal workpiece. As a result, the blanking or punching of the parts is performed in sequence, but the holding of the workpiece is performed by one plate without any sequence.

SUMMARY OF THE INVENTION

The present invention is directed to an improved method and apparatus for constructing and operating the tooling for a press for producing a plurality of cup-like articles with each stroke of the press and which provides for significantly increasing the operational speed of the press to obtain a higher production rate without overloading components of the press. For example, a cupping press equipped with tooling constructed in accordance with the present invention is capable of obtaining more than a 50% decrease in the compressive forces or loading on the outer raim and this decrease permits the speed of the press to be increased from about 150 spm to about 250 spm without exceeding the load rating of the press.

In accordance with one embodiment of the invention, a cupping press is equipped with multiple stage tooling wherein each stage includes a plurality of tooling sets each including an annular draw pad opposing a corresponding annular blank and draw die, an annular cut edge die surrounding each of the draw pads and a corresponding die center punch within each of the draw pads. The tooling stages are constructed for sequentially engaging the sheet metal with a precise timing sequence which provides for sequentially blanking a series of nested and out-of-round or contoured blanks between the cut edge dies and the corresponding blank and draw dies during each stroke of the press, sequentially holding the blanks between the draw pads and the corresponding blank and draw dies, and then sequentially drawing the blanks into cups with the die center punches extending into the corresponding blank and draw dies. Also in accordance with the invention, the tooling of an existing cupping press may be easily modified by installing a series of annular shims for some of the draw pads and the retainers for the cut edge dies and by lowering the retainers supporting some of the blank and draw dies. The tooling at each stage may also include a pressure sleeve surrounding a bottom panel punch within the blank and draw die for forming a preform boss within the bottom wall of each cup. The present invention further provides for conveniently and quickly removing upper and lower tooling components to simplify servicing of the tooling after an extended period of use.

Other features and advantages of the invention will be apparent from the following description, the accompanying drawings and the appended claims.

BRIEF DESCRIPTION OF THE DRAWINGS

FIGS. 5–7 are enlarged fragmentary sections of the tooling components shown in FIGS. 2 & 3 and illustrating the sequential blanking, holding and drawing operations in accordance with invention;

FIG. 8 is a chart illustrating the relative positions of the multiple stage or stepped tooling components shown in and FIGS. 2 & 5–7;

DESCRIPTION OF THE PREFERRED EMBODIMENTS

Figure 1:
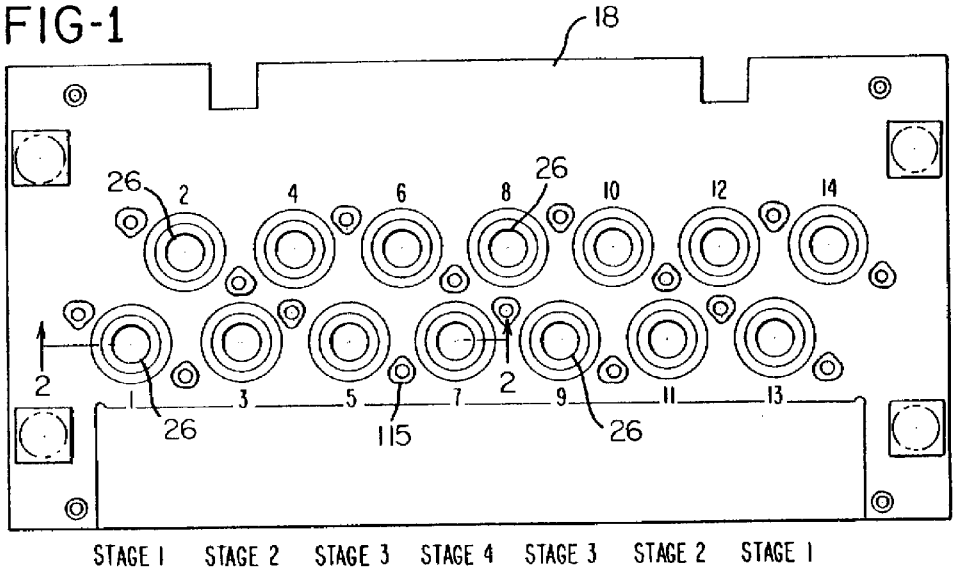
FIG. 1 is a general plan view of lower cup forming tooling constructed in accordance with the invention and with the stock plate removed.

FIG. 1 illustrates a plan view of the lower or bottom tooling of a fourteen cup or fourteen out tooling system 15 which includes a lower die shoe 18 secured to a bed 20 (FIG. 2) of a double action mechanical press. The press also includes an inner ram 22 and an outer ram 24, with the inner ram 22 having a vertical stroke, for example, of about five inches and the outer ram 24 having a substantially shorter stroke, for example, about two inches. As shown in FIG. 1, the lower die shoe 18 has a series of fourteen holes or pockets 26 which extend vertically or downwardly through the lower die shoe 18 to a cup discharge chamber 28. The pockets 26 are arranged in four stages (FIG. 1) with pockets 1, 2, 13 and 14 forming stage 1, pockets 3, 4, 11 and 12 forming stage 2, pockets 5, 6, 9 and 10 forming stage 3 and pockets 7 and 8 forming the center stage 4.

The inner ram 22 (FIG. 2) supports an upper or inner die shoe 32. A series of vertical risers 34 are secured to the bottom surface of the inner die shoe 32 and extend downwardly in vertical alignment with the corresponding pockets 26. A die center punch 38 (FIG. 3) is secured to the lower end portion of each riser 34 by a center screw 39 and a precision locator pin 41, and each die center punch 38 carries a hardened outer wear sleeve 42. Each of the risers 34 and the corresponding die center punch 38 have a vertically extending air passage 44 which receives a supply of pressurized air at timed intervals for removing cups from the punch. As apparent from FIG. 2, the risers 34 and corresponding die center punches 38 are carried by and move vertically with the inner ram 22 through the attached inner die shoe 32.

Figure 2:
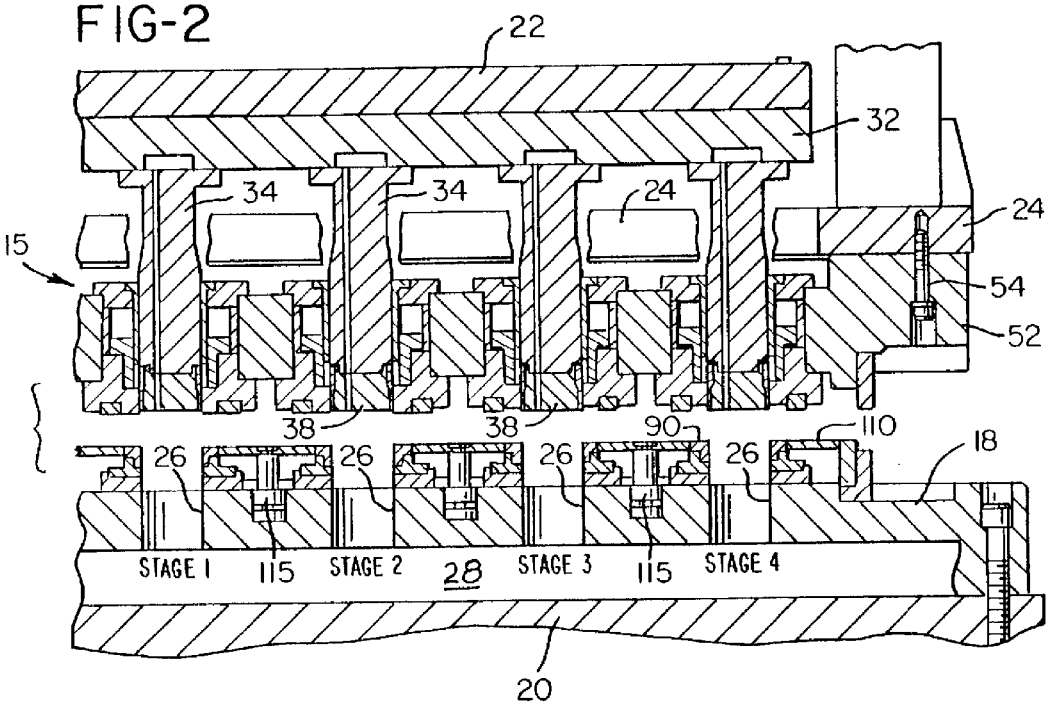
FIG. 2 is a fragmentary section of the upper and lower cup forming tooling in a double action press, and showing the multiple stages of the tooling as taken generally on the line 2—2 of FIG. 1.
Figure 3:
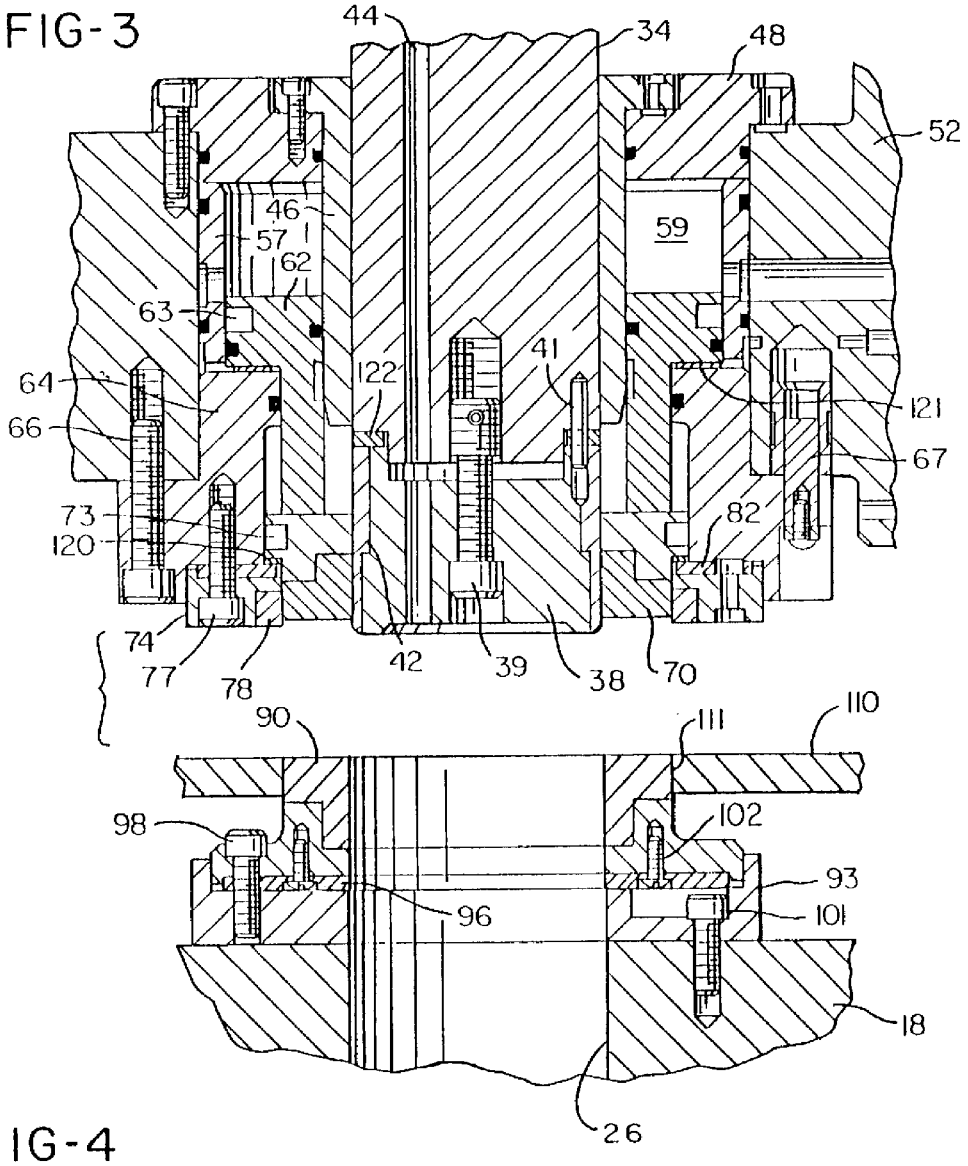
FIG. 3 is an enlarged fragmentary section of one of the tooling stages shown in FIG. 2.

Since the tooling set or components for each pocket 26 are substantially the same, only the components for one pocket are described in reference to FIG. 3. A cylindrical guide sleeve 46 (FIG. 3) surrounds each of the risers 34 and has an upper flange secured to an annular plate 48 which is mounted on an upper die shoe 52. The upper die shoe 52 is carried by the outer ram 24 through a series of peripherally spaced screws 54 (FIG. 2). A cylindrical liner 57 lines a bore within the upper die shoe 52 and cooperates with the sleeve 46 and plate 48 to define a fluid or air chamber 59 which receives the head portion of a piston 62. The head portion carries wear pads (not shown) within peripherally spaced holes 63 and is confined within the chamber 59 by an annular retainer 64 secured to the upper die shoe 52 by peripherally spaced screws 66 and a precision locator pin 67.

A two section draw pad 70 is supported for vertical sliding movement within the annular retainer 64 below the piston 62, and the bottom surface of the draw pad 70 has a series of fine concentric grooves or recesses to form an irregular surface. The lower portion of the draw pad 70 is formed from a harder steel than the upper portion which engages the piston 62 and carries wear pads (not shown) within peripherally spaced holes 73. The draw pad 70 is retained within the annular retainer 64 by an annular cut edge retainer 74 secured to the retainer 64 by a series of peripherally spaced screws 77. The retainer 74 supports a hardened annular shearing die or cut edge 78 which surrounds the draw pad 70. A hardened flat spacer ring 82 is recessed within the upper portion of the cut edge retainer 74 and forms a lower limit of movement for the draw pad 70.

As illustrated in FIG. 3, each of the holes or pockets 26 within the lower die shoe 18 is vertically aligned with the corresponding die center punch 38 and is slightly larger in diameter. Also vertically aligned with each of the pockets 26 within the lower die shoe 18 is a two section annular blank and draw die 90 which is supported in a circular recess of an annular retainer 93 by a flat annular spacer 96. Each blank and draw die 90 is secured to its corresponding retainer 93 by a set of peripherally spaced screws 98, and another set of screws 101 secures each retainer 93 to the lower die shoe 18. A set of screws 102 secures the spacer 96 to the blank and draw die 90. Locating pins and bushings (not shown) are also used to align each blank and draw die 90 and its retainer 93 precisely on the lower die shoe 18. As also shown in FIG. 3, the upper portion or section of the blank and draw die 90 consists of a hardened ring which is inserted and positively retained within the lower portion or section of the die 90.

Figure 4:
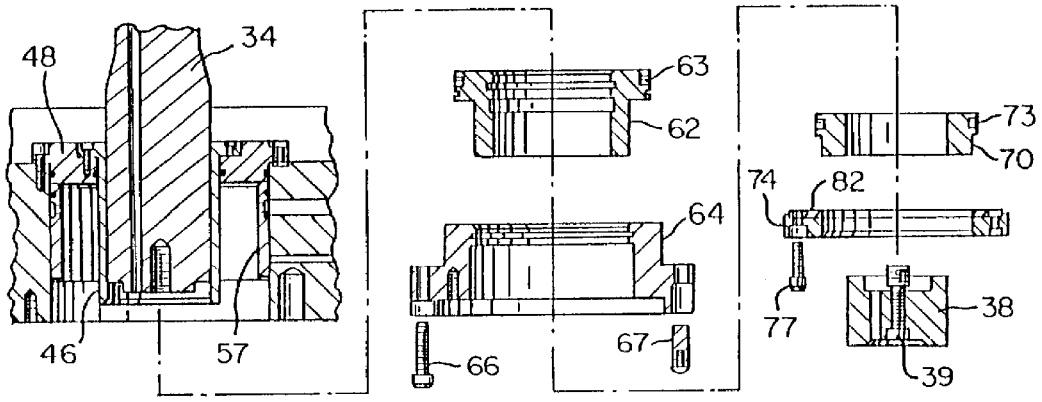
FIG. 4 is a fragmentary exploded view illustrating the assembly of upper tooling components shown in FIG. 3.

Referring to FIG. 4, the die center punch 38, draw pad 70, surrounding cut edge retainer 74 and cut edge 78, piston 62 and piston retainer 64, which form part of the upper tooling on the upper die shoe 52, may be conveniently and quickly removed from the die shoe 52, simply by removing the screws 39, 66 and 77. Furthermore, these components may be removed for replacing components such as wear pads or piston sealing rings without further elevation of the upper die shoe 52 or without further disassembly of the upper tooling.

Referring to FIGS. 2 and 3, a flat stock plate 110 forms part of the bottom or lower tooling and defines a circular opening or clearance hole 111 for receiving each of the blank and draw dies 90. The stock plate 110 is supported with its upper surface generally flush with the upper surface of the blank and draw dies 90 by a series of spring biased pistons 115 (FIG. 2) which are located within the lower die shoe 18 between and around the blank and draw dies 90, as shown in FIG. 1. The spring loaded pistons 115 biased the stock plate 110 to its elevated position (FIGS. 2 and 3) with a predetermined force, but permit the stock plate 110 to move downwardly by a fraction of an inch when the force is exceeded by the downward movement of the cut edges 78 and retainers 74.

Referring to FIGS. 5–8, the multiple stage tooling described above in connection with FIGS. 1–4, operates to perform sequential blanking, holding and drawing operations with respect to sets of the holes or pockets 26. These sequential operations are performed by precisely positioning each stage of the blank and draw dies 90, the draw pads 70 and the die center punches 38 at predetermined elevations relative to the press bed 20. For example, existing cupping tooling may be modified by grinding the bottom surfaces of some of the blank and draw die retainers 93 to lower the blank and draw dies, and by adding a set of shims to the upper tooling for each of the stages 2, 3 and 4.

Referring to FIG. 3, which illustrates stage 4 of the tooling shown in FIGS. 1 and 2, a flat annular shim 120 limits the downward movement of each draw pad 70 relative to its surrounding cut edge 78, and an annular flat shim 121 limits the downward movement of the corresponding air actuated piston 62 which presses downwardly with a predetermined pressure on the draw pad 70. Another annular flat shim 122 spaces or lowers each of some of the die center punches 38 with respect to its supporting riser 34 and precisely determines the elevation of the die center punch with respect to its surrounding draw pad 70.

As shown, for example, in the chart of FIG. 8, the blank and draw dies 90 for the holes of stages 1 and 2 are each lowered by 0.012 inch. This lowering is accomplished by grinding the bottom surfaces of the retainers 93 supporting the corresponding blank and draw dies 90. The shims 120 and 121 for the stage 2 pockets 3, 4, 11 and 12 have a thickness of 0.020 inch so that the pistons 62 for the pockets of stage 2 and the corresponding draw pads 70 are elevated by 0.020 inch above the pistons 62 and draw pads 70 for the stage 1 pockets 1, 2, 13 and 14. The die center shims 122 for the stage 2 pockets 3, 4, 11 and 12 have a thickness of 0.060 inch so that the die center punches 38 for these pockets are lowered by 0.060 inch relative to the die center punches for the stage 1 pockets.

As also apparent from the chart of FIG. 8, the shims 120 and 121 for the stage 3 pockets 5, 6, 9 and 10 have a thickness of 0.052 inch so that the pistons 62 and draw pads 70 for these pockets are elevated by 0.040 inch above the draw pads 70 for the stage 2 pockets. The die center punch shims 122 for the stage 3 pockets have a thickness of 0.116 inch so that the die center punches 38 for these pockets are 0.056 inch lower than the die center punches for the stage 2 pockets. Similarly, the shims 120 and 121 for the stage 4 pockets 7 and 8 have thickness of 0.072 inch, and the die center punch shims 122 for these pockets have a thickness 0.198 inch so that the draw pads for these pockets are elevated by 0.020 inch above the draw pads 70 for the stage 3 pockets, and the die center punches 38 for the stage 4 pockets are 0.082 inch lower than the die center punches 38 for the stage 3 pockets.

Referring to FIGS. 5–7, a sheet S of metal, such as 0.011 inch thick aluminum, is fed between the upper tooling and lower tooling in the downward direction in FIG. 1. The downward movement of the outer ram 24 and the upper die shoe 52 causes the sheet S to be sequentially sheared or blanked between the annular cut edges 78 and the annular blank and draw dies 90 for the stages 1–4 for progressively forming the flat circular blanks B. As apparent from FIG. 5, the blanks B are sequentially clamped or held against the blank and draw dies 90 by the draw pads 70 for the stages 1–4 as a result of the shims 120 and 121 with increasing thickness. As apparent from FIGS. 6 and 7, the downward movement of the inner ram 22 and inner die shoe 32 causes the die center punches 38 for the stages 1–4 to engage the blanks B sequentially and to draw the blanks sequentially into corresponding cups C. As shown in FIG. 7, the increasing thickness of the shims 122 above the die center punches 38 for stages 1–4, results in the cups C being sequentially drawn in a reverse order, with the cups C for stage 4 being fully drawn prior to the cups for stage 3 being fully drawn and prior to the cups for stage 2 being fully drawn prior to the cups at stage 1.

Figure 9:
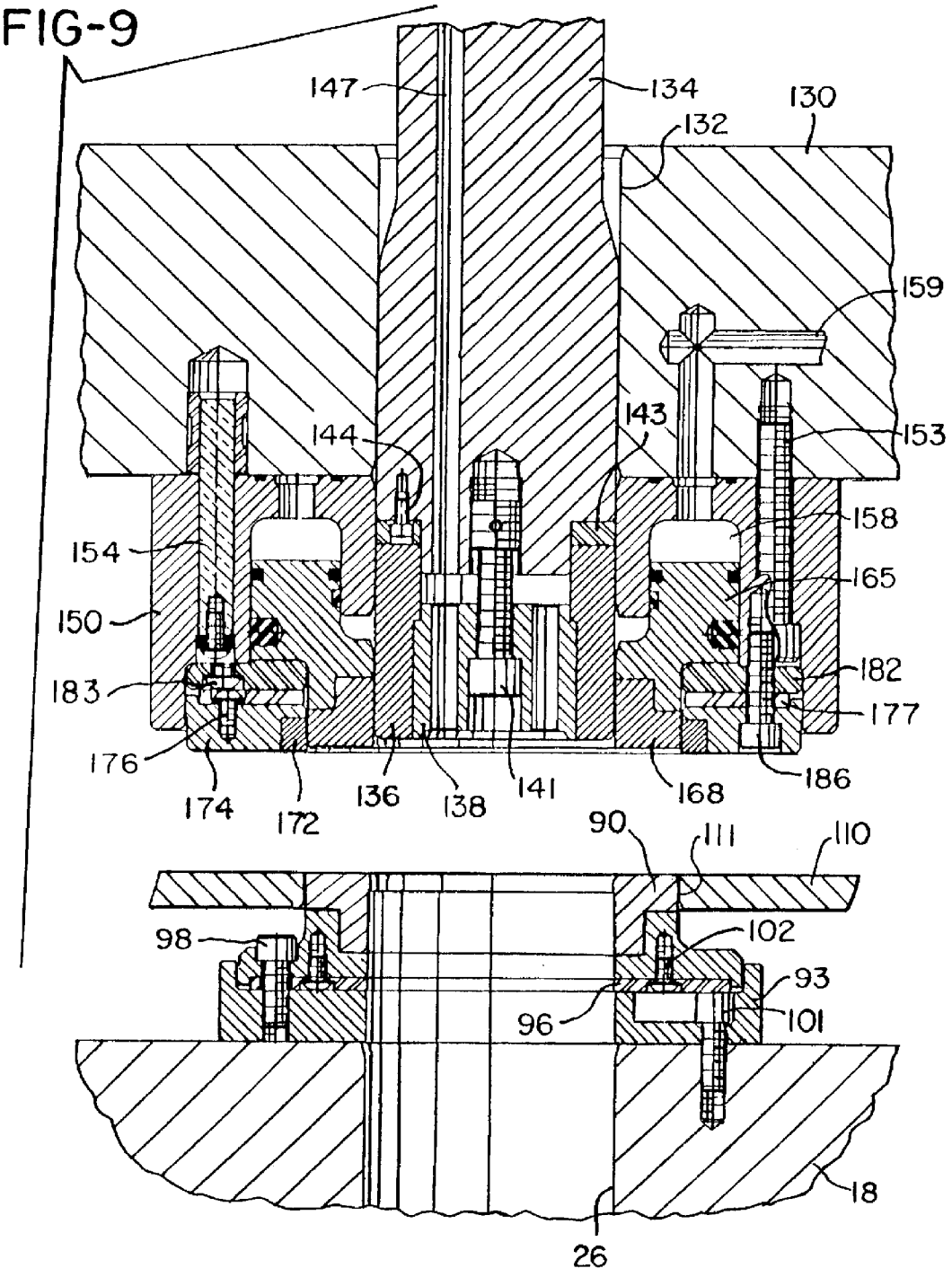
FIG. 9 is a fragmentary section similar to FIG. 3 and showing a modification of a tooling stage.

FIG. 9 illustrates a fragmentary section of cup forming tooling constructed in accordance with another embodiment of the invention and similar to the cup forming tooling described above in connection with FIGS. 3 and 4. In FIG. 9, an upper die shoe 130 is connected to the outer ram 24 for vertical reciprocating movement, for example, with a stroke of about two inches. A cylindrical bore 132 is formed within the upper die shoe 130 for each of the tooling pockets or stations and slidably supports a corresponding riser 134 which is connected to the inner die shoe 32 for vertical reciprocating movement with a stroke, for example, of about 5 inches. The lower end portion of each riser 134 carries an annular die center punch 136 secured to the riser by an annular hub 138 and a center screw 141. An annular spacer shim or ring 143 is located between the die center punch 136 and an annular shoulder on the riser 134, and the spacer ring 143 is secured to the riser 134 by a series of peripherally spaced screws 144. An air passage 147 extends axially within the riser 134 and hub 138 for receiving pulses of pressurized air, as explained above in connection with the air passage 44.

An annular body or retainer 150 surrounds each of the risers 134 and corresponding die center punch 136 and is attached to the bottom surface of the upper die shoe 130 by a series of circumferentially spaced and axially extending screws 153 and a set of precision locating pins 154. The retainer 150 defines an annular chamber 158 which receives pressurized air through a passage 159 within the upper die shoe 130. An annular piston 165 is supported within the chamber 158 for axial movement and has a lower portion connected directly to an annular draw pad 168 which surrounds the die center punch 136. The draw pad 168 is preferably formed of a harder material than the piston 165 and is attached by a press-fit connection.

An annular cut edge die 172 surrounds the draw pad 168 and is secured to an annular cut edge retainer 174 by a press-fit connection. A flat spacer ring 177 is secured to the cut edge retainer 174 by a series of circumferentially spaced screws 176, and a retainer ring 182 is secured to the retainer 150 by a series of circumferentially spaced and axially extending screws 183. The ring 182 forms a seat for the piston 165 and limits the downward movement of the piston 165. A series of circumferentially spaced screws 186 extend axially through aligned holes within the cut edge retainer 174, spacer ring 177 and retainer ring 182, and are threaded into the retainer 150. As apparent from FIG. 9, removal of the screws 186 permits convenient removal of the cut edge die 172 and die retainer 174, and removal of the screws 183 provide for convenient removal of the retainer ring 182 and the piston 165 with the attached draw pad 168. The retainer 150 may be removed by removing the screws 153.

Since the tooling components mounted on the lower die shoe 18 are substantially identical to the lower tooling components described above in connection with FIG. 3, the same reference numbers are used for the various components or parts. As apparent from a comparison of the upper tooling shown in FIG. 9 and the upper tooling shown in FIG. 3, the tooling of FIG. 9 performs the same function but uses significantly fewer parts. The tooling components shown in FIG. 9 are also conveniently removable from the upper die shoe 130 when the die shoe is retracted, simply by removing the screws 141, 186, 183 and 153.

Figure 10:
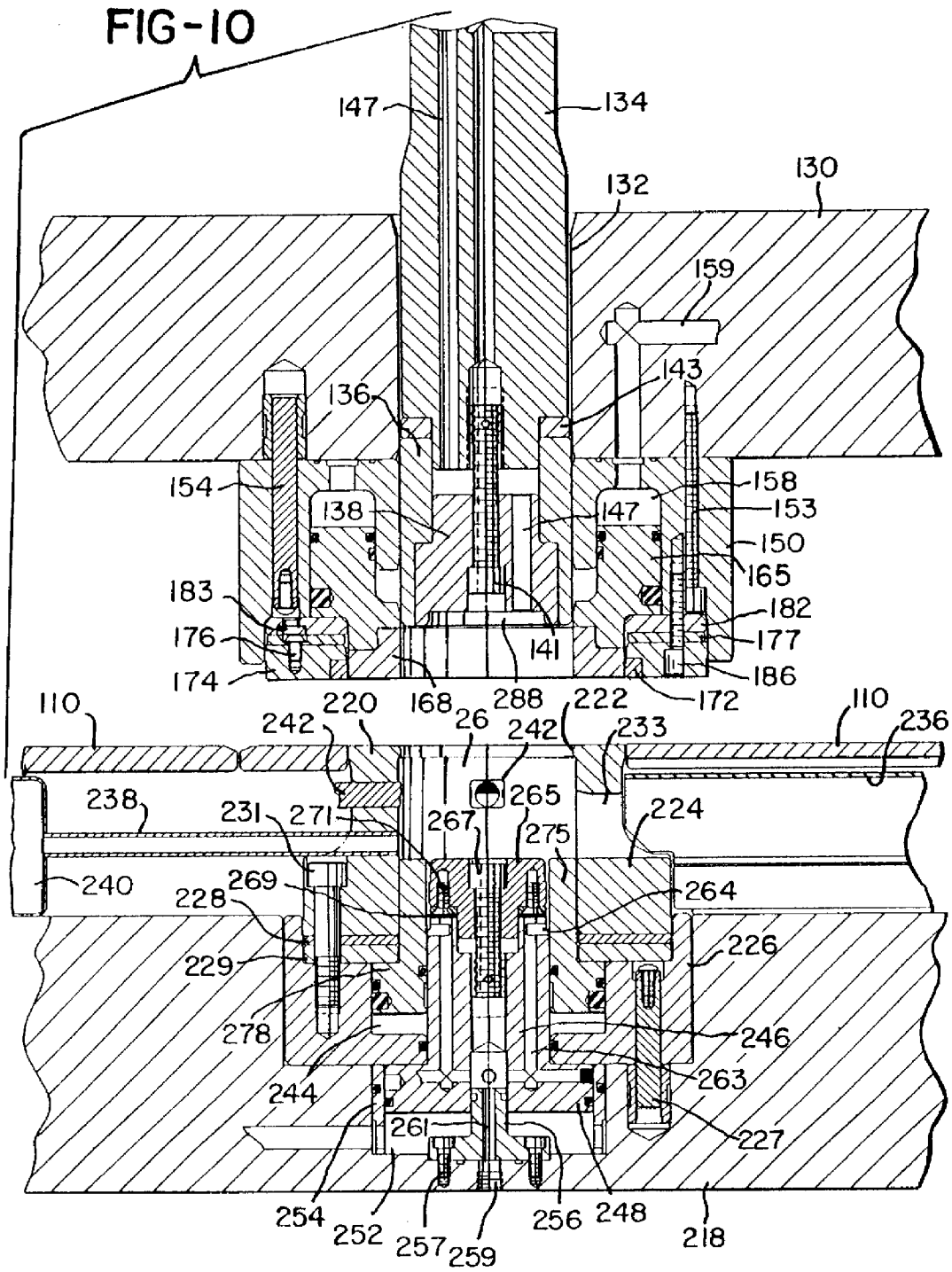
FIG. 10 is a fragmentary section similar to FIGS. 3 and 9 and showing another tooling embodiment of the invention.

The above described sequential tooling apparatus and its method of use are ideally suited for the production or forming of metal cups having bottom walls with inwardly or upwardly projecting bosses, for example, as disclosed in U.S. Pat. No. 5,394,727. As disclosed in this patent, the upwardly projecting boss is reformed to form an annular bottom wall portion having a frusto-conical cross-sectional configuration. In accordance with the present invention, the tooling apparatus for producing such cups includes multiple stages such as the four stages shown in FIG. 1 and described above. Each stage preferably includes a plurality of tooling sets each constructed as shown in FIG. 10 and which would be substantially the same at each of the pockets 26 referred to above in connection with FIG. 1. Accordingly, only one set of cupper tooling will be described.

Referring to FIG. 10, the upper tooling components which are connected to the inner ram 22 and the outer ram 24 are substantially the same as the tooling components described above in connection with FIG. 9. Accordingly, the components carry the same corresponding reference numbers. However, the die set includes different lower tooling components which are mounted on a lower die shoe 218 (FIG. 10) also constructed differently than the lower die shoe 18 described above in connection with FIG. 2.

As shown in FIG. 10, a lower die shoe 218 supports a blank and draw die 220 for each tooling station and which has an inwardly projecting annular lip 222 defining the corresponding die pocket 26 (FIG. 1). Each blank and draw die 220 has substantial height to form generally a cylindrical column and has an annular base 224 which is secured to an annular retainer 226 recessed within a counterbore formed within the lower die shoe 218 and positioned by a locating pin 227. The blank and draw die 220 seats on a set of annular spacer or shim plates 228 and 229 and is secured to the retainer by peripherally spaced screws 231.

Figure 15:
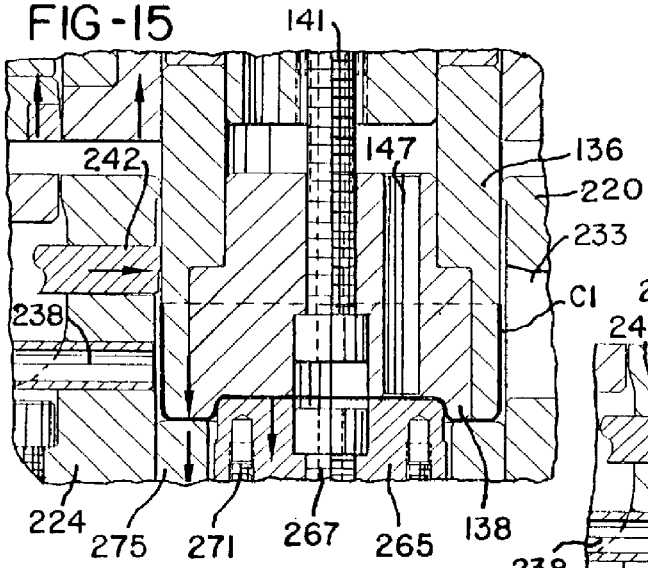
Figure 16:
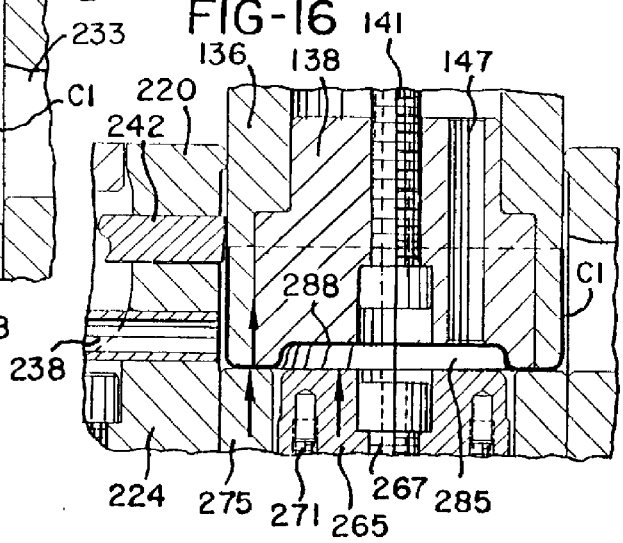
Figure 17:
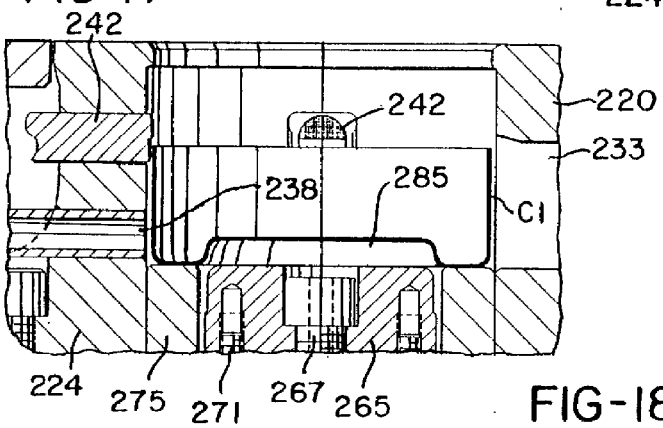

A laterally extending cup discharge opening or port 233 is formed within the blank and draw die 220 and connects with a tubular discharge conveyor or duct 236. An air jet tube 238 extends from a pressure air supply duct 240 through the opposite side of the blank and draw die 220. A set of three stripper fingers 242 also project laterally through the blank and draw die 220, and each finger is spring biased inwardly to a stripping position (FIGS. 10 & 15). An annular air chamber 244 is defined within the tooling retainer 226 and is closed by a cylindrical rod portion 246 of an overstroke piston 248 supported for vertical movement within an air chamber 252 defined by a cylindrical sleeve 254 lining a counterbore within the lower die shoe 218. A cylindrical stationary hub 256 has a bottom flange secured to the lower die shoe 218 by a set of screws 257 within the center of the chamber 252. The hub 256 projects upwardly into a cylindrical bore within the overstroke piston 248, and pressurized air is supplied to a port 259 and passages 261 and 263 and discharge ports 264 within the piston rod 246, for a purpose which will be explained later.

A substantially cylindrical bottom panel punch 265 is secured to the overstroke piston rod 246 by a center screw 267, an annular spacer plate 269 is secured to an annular shoulder on the panel punch 265 by a set of screws 271. A lower pressure sleeve 275 surrounds the panel punch 265 and is supported for vertical movement within the lower portion 224 of the blank and draw die 220. The pressure sleeve 275 includes a lower annular head or piston 278 which is slidably supported within the air chamber 244. A series of resilient O-ring seals are confined within corresponding grooves within the pistons 248 and 278 and within the annular retainer 226, sleeve 254, and rod 256 to form fluid-tight seals for confining pressurized air within the annular air chambers 244 and 252.

Figure 11:
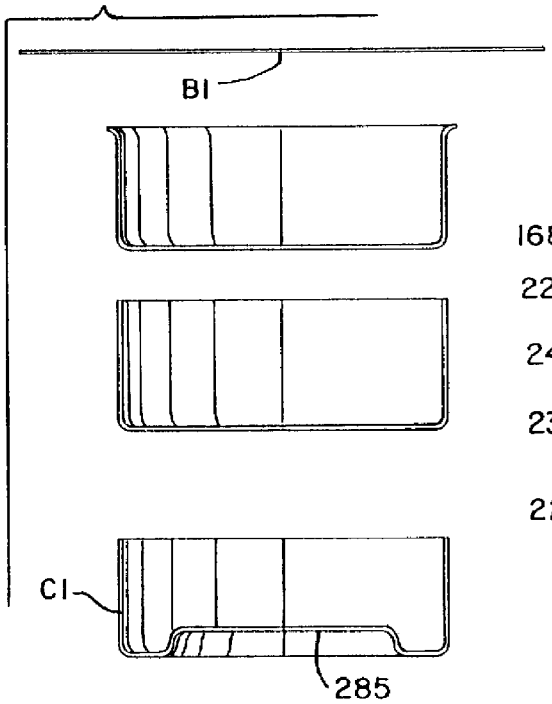
FIG. 11 generally illustrates the drawing of a cup with a bottom preform boss using the tooling shown in FIG. 10.
Figure 12:
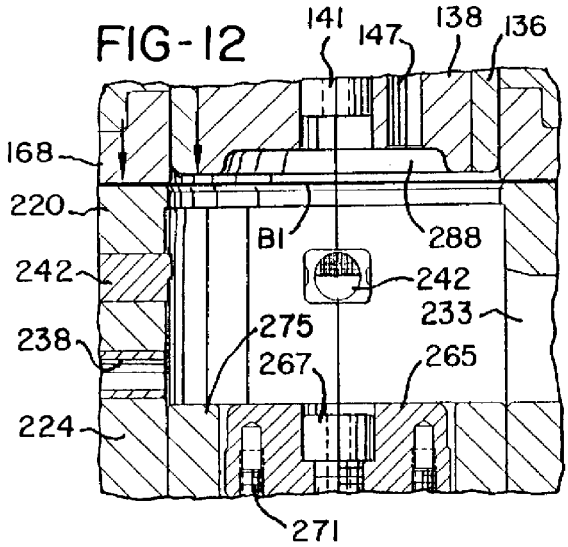
FIGS. 12–18 are fragmentary sections of the tooling components shown in FIG. 10 at different progressive positions for forming the cup shown in FIG. 11.
Figure 13:
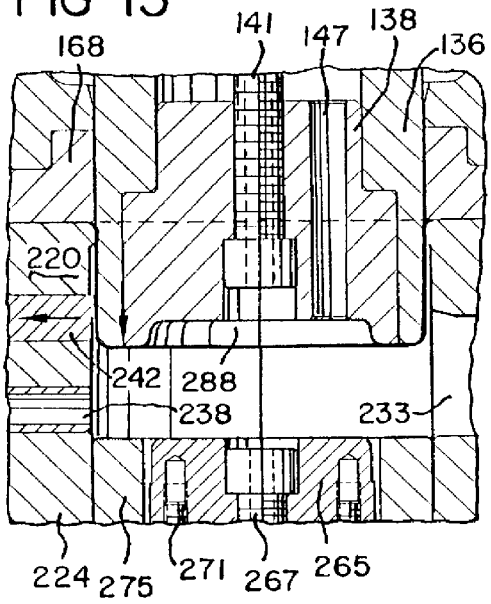

Referring to FIG. 11, the set of tooling components described above in connection with FIG. 10 for each die station or pocket is effective with an inwardly or upwardly projecting generally cylindrical boss 285. As mentioned above, the boss 285 is used in a redrawing and reforming operation, as disclosed in U.S. Pat. No. 5,394,727, to form a bottom end profile on a beverage container as shown in FIG. 8 of the patent, the disclosure of which is hereby incorporated by reference. During each stroke of the double action press, a cup C1 is formed at each die station from a corresponding blank B1. FIGS. 12–17 illustrate the tooling components in various positions and a cup in various corresponding conditions with the downward and upward movement of the inner and outer rams of the double action press.

Figure 14:
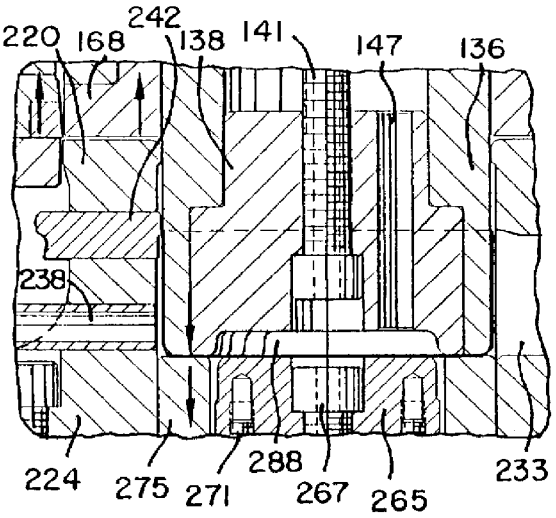

As apparent from FIGS. 14 & 15, the boss 285 is formed within each cup C1 towards the bottom stroke of the inner ram 22 and the connected die center punch 136. As the die center punch 136 presses the bottom wall of the cup C1 against the upper end of the annular pressure sleeve 275 (FIG. 14), the panel punch 265 then continues to press an inner portion of the bottom wall upwardly into the circular cavity 288 within the hub portion 138 of the die center punch 136 (FIG. 15) to form the boss 285. Preferably, the air supplied to the chamber 244 (FIG. 10) is within a pressure range of 30 to 40 psi while the pressure supplied to the overstroke chamber 252 is maintained about 400 psi. Thus the panel punch 265 (FIG. 15) moves downwardly by only a few thousandth inch during an overstroke after the boss 285 is formed within the cavity 288 of the die center punch hub 138.

Figure 18:
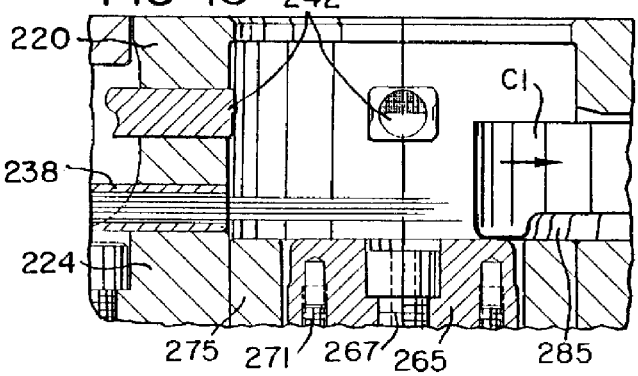

As the inner ram 22 moves upwardly after the bottom of the press stroke (FIG. 16), the cup moves upwardly with the die center punch 136 as a result of the upward force urged by the pressure sleeve 275 and pressurized air which is supplied under the cup through the air supply passages 259 and 263 and ports 264. When the cup C1 moves upwardly to the position shown in FIGS. 16 & 17, the stripper fingers 242 engage the upper edge of the cup and strip it from the die center punch 136. As soon as the die center punch moves above the cup C1 and the cup is stripped, the air jet from the tube 238 blows the cup through the port 233 and into the air conveyor tube or duct 236, as illustrated in FIG. 18. Thus each cup is discharged laterally from the press below the level of the sheet metal stock resting on the stock plate 110.

By precisely selecting the thickness of each of the shim washers or plates 143, 182, 229 and 269 for the various four stages, the blanks B1 are sequentially cut or punched between the cut edges 172 and the corresponding blank and draw dies 220, are sequentially held between the draw pads 168 and corresponding blank and draw dies 220, and are sequentially drawn by the die center punches 136 moving into the corresponding blank and draw dies 220. In addition, the bosses 285 on the cups C1 are sequentially formed or drawn at the four stages.

Figure 19:
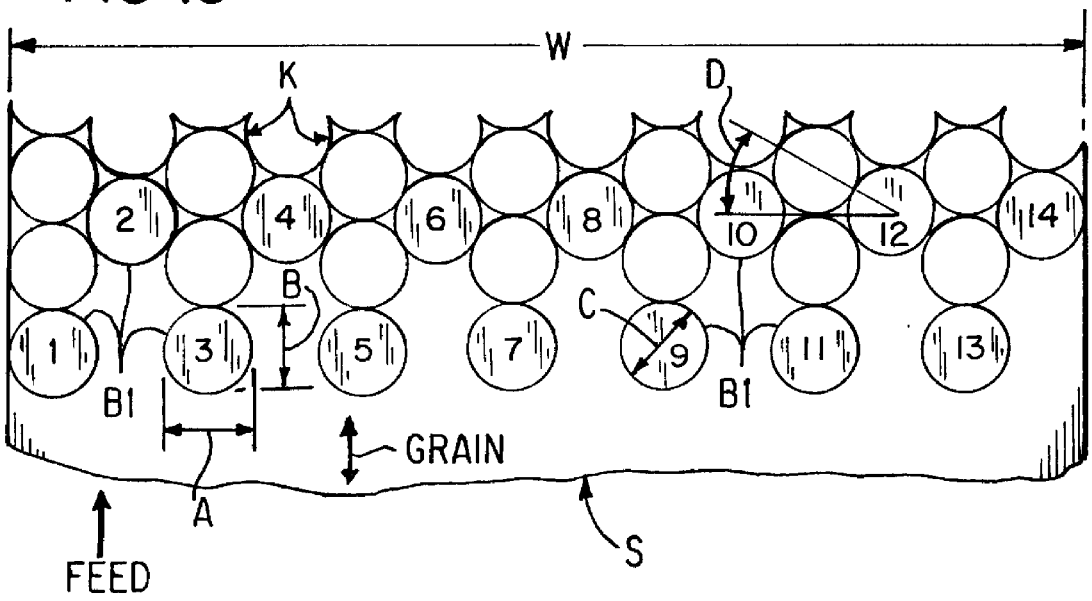
FIG. 19 is a fragmentary plan view of a blanked metal sheet for illustrating the nested and out-of-round or contoured blanking operations.

Referring to FIG. 19, a strip or sheet S of metal or aluminum is fed in step-by-step progression into a mechanical double action mechanical press equipped with fourteen sets of tooling components as shown in FIG. 10, and preferably with the tooling sets or stations arranged in four stages as described above in connection with FIGS. 5–8. The cut edge 172 and blank and draw die 220 at each of the tooling stations is constructed to produce a slightly out-of-round or contoured blank B1. For example, with a generally circular blank having a nominal diameter of 5.700 inches, the diameter A of each blank B1 across the grain or across the sheet S is 5.720, and the diameter B with the grain or in the direction of feed is 5.670 inches. The diameter C at 45° is also 5.670 inches.

The out-of-round or contoured blanks B1 are also nested, as shown in FIG. 19, in order to minimize the width W of the strip or sheet S across the grain. That is, instead of the centerlines of the tooling sets being arranged to produce blanks having centers defining an angle D of 30°, the centerlines are arranged at an angle D which is slightly different or off from 30°, and preferably at an angle D of 30° 2'8". By arranging the centerlines of the tooling sets at the angle D of 30° 2'8", the width W of the strip S may be significantly reduced, for example, up to ⅜ inch, resulting in a significant reduction in the weight and cost of the strip S. In addition, the nesting of the tooling sets or stations to produce the out-of-round or contoured blanks B also provides for reducing the feed progression of the strip S which cooperates to minimize the weight of the scrap or skeleton K after the blanks B1 are removed. For example, the savings in sheet metal on a press operating 85% of the time with tooling sets constructed and arranged in accordance with the invention for producing fourteen cups with each stroke of the press, results in a savings of over $590,000 per year. In addition, the out-of-round or contoured blanks B1 result in producing cups C1 with a substantially flat top edge or with minimum earing on the top edge of each cup.

Figure 20:
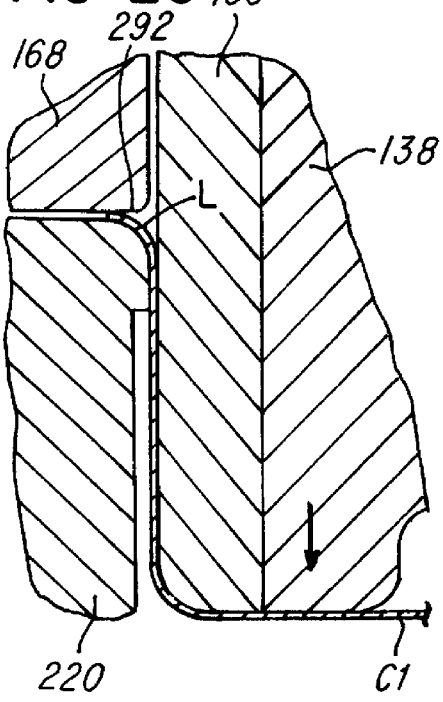
FIGS. 20 & 21 are enlarged fragmentary sections of certain tooling components for illustrating the shape and position of each draw pad during final drawing of each cup.
Figure 21:
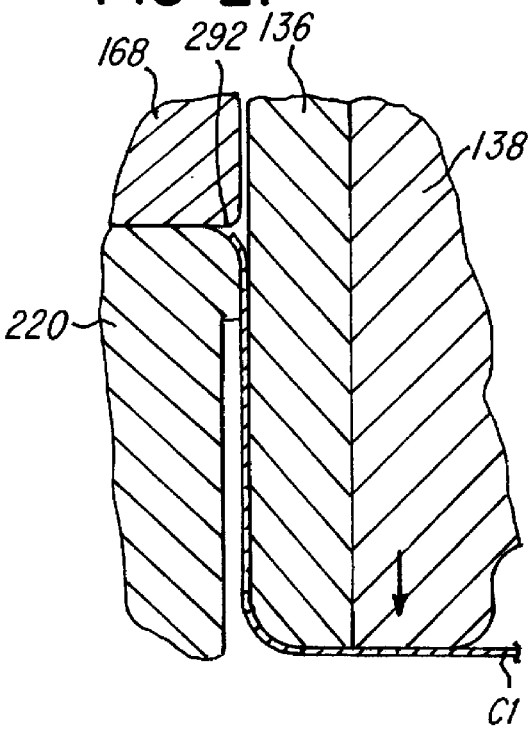

Referring to FIGS. 20 and 21 which are substantial enlargements of portions of the tooling components shown in FIGS. 12–18, it is common in the prior art for the draw pad 168 to be moving up during the final forming of each cup C1 when the outwardly projecting lip L is in the position shown in FIG. 20. As a result, the draw pad 168 removes pressure on the upper edge and lip L of each cup when the upper edge reaches the tangent point on the blank and draw die 220.

In accordance with the present invention, the downward pressure on each draw pad 168 by the back-up piston 165 is continued as the lip L flows or forms around the annular radius of the blank and draw die 220, as shown in FIGS. 20 and 21, so that the draw pad 168 does not lift off. The downward pressure on the draw pad 168 continues causing the draw pad to engage the top surface of the blank and draw die 220. When the downward movement of the draw pad 168 is stopped by the blank and draw die 220 (FIG. 21), any further downward movement of the outer ram, results in the draw pad piston 165 moving slightly upwardly within the corresponding air chamber 158. As also shown in FIG. 20, the annular inner bottom edge of each draw pad 168 is provided with a tapered or slightly frusto-conical annular surface 292 which cooperates with the continued downward pressure on the draw pad 168 by the piston 165 to produce higher quality or improved cups C1.

By preventing lift off of the draw pad 168 before it engages the blank and draw die 220, in accordance with the invention, the roundness of the cups is greatly improved, even when the gage of the strip or sheet S is reduced. The increased roundness of the cups provides for more dependable feeding of the cups into the bodymaker press and thereby reduces scrap. The improved cup producing tooling of the invention and its operation also provide for efficiently producing cups C1 with bottom preforms 285 (FIG. 11) without modifying the crankshaft on a standard double action press which has an outer ram with a two inch stroke and an inner ram with a five inch stroke, as mentioned above.

From the drawings and the above description, it is apparent that a mechanical cupping press equipped with tooling constructed in accordance with the present invention, provides desirable features and advantages. As one important feature, by sequentially gripping or holding the blanks B or B1 between the draw pads 70 or 168 and the blank and draw dies 90 or 220 for the stages 1–4, the dynamic loading on the outer ram 24 is substantially reduced. For example, the compressive load of 98 tons on the outer ram of a 150 ton press with eight pocket tooling operating at 250 spm, is reduced to a compressive load of 48 tons with tooling constructed in accordance with the present invention. This represents a compressive load reduction on the outer ram of over 50% and thus permits substantially increasing the speed of the press without overloading the press.

Furthermore, by combining the sequencing operations with the tooling components shown in FIG. 10 at each station, cups C1 with preformed bosses 285 may be produced at high speed using existing presses with an outer ram having a two inch stroke and an inner ram with a five inch stroke. Thus cupper presses existing in the field may be retrofitted with sequential stage tooling as shown in FIG. 10. As a result, it has been found that a 150 ton cupping press may be operated at 250 strokes per minute without overloading either of the inner or outer rams of the press.

While the sequential holding of the blanks B or B1 provides the greatest reduction in the loading on the press, the sequential blanking of the sheet S to form the flat generally circular blanks B or B1 also decreases the compressive loading on the outer ram of the double action press, and the sequential drawing of the blanks B or B1 into the cups C or C1 also significantly reduces the loading on the inner ram 22. It is also apparent that the sequential tooling reduces the maximum tensile loading on the press components during the instant when the rams reverse their directions at the bottom of their strokes.

While the invention is illustrated by the use of shims 120, 121 and 122 or shims 143, 182, 229 and 269 to perform the sequential blanking, holding and drawing operations with cupper tooling, it is apparent that new cupper tooling may be constructed with dimensions which eliminate the need for the shims. Furthermore, while the chart of FIG. 8 illustrates a stepping sequence for a fourteen cup or pocket tool ing, the step differentiation for the stages 1–4 may be modified according to the number of stages, the number of pockets, the type of tooling and the type of mechanical press. Also, the term cup-like articles, as used herein, includes a plurality of any drawn sheet metal articles each of which has a bottom wall integrally connected to an upwardly projecting annular wall.

Additional important advantages are provided by constructing and operating the sets of tooling as described above in connection with FIGS. 19–21. That is, by producing the nested and out-of-round or contoured blanks B1 with the tooling sets, the width of the strip S may be significantly reduced with a corresponding reduction in cost of material. It has also been determined that the out-of-round or contoured blanks B1 have less square inches of material than circular blanks and produce cups C1 which draw into taller cans in a bodymaking press. As a result, the gage of the aluminum strip S may be reduced, for example, from 0.0106" to 0.0103" to produce cans having a predetermined height and substantially flat top edges. This reduction in gage also contributes to a further reduction in cost of material.

While the methods and forms of apparatus herein described constitute preferred embodiments of the invention, it is to be understood that the invention is not limited to the precise methods and forms of apparatus described, and that changes may be made therein without departing from the scope and spirit of the invention as defined in the appended claims.

The invention having thus been described, the following is claimed:

1. A method of forming a batch of cups from a strip of sheet metal with each stroke of a double action mechanical press including an inner ram and an outer ram each supported for reciprocating movement, the rams supporting tooling comprising a series of horizontally spaced and substantially identical cup-forming stations each including an annular draw pad, an annular blank and draw die opposing the annular draw pad at each station, an annular cut edge die surrounding the draw pad at each station, and a die center punch within the draw pad at each station, the method comprising the steps of forming the cut edge die and the blank and draw die at each station to produce an out-of-round disk-like blank, arranging the tooling stations to produce nested blanks with adjacent blanks having centers defining a line forming an angle different than thirty degrees with a line perpendicular to the direction of feed of the strip through the press, cutting the strip between the annular cut edge dies and the corresponding annular blank and draw dies for forming the blanks, holding the metal blanks between the annular draw pads and the corresponding annular blank and draw dies at the stations, and engaging center portions of the blanks with the corresponding die center punches for drawing the blanks into cups.

2. A method as defined in claim 1 wherein the cut edge die and the blank and draw die at each station have a diameter in the direction of feed of the strip through the press less than the diameter in a direction perpendicular to the direction of feed and across the width of the strip.

3. A method as defined in claim 2 wherein the tooling stations are arranged to produce nested blanks with adjacent blanks having centers defining a line forming an angle slightly greater than thirty degrees with a line perpendicular to the direction of feed of the strip through the press.

4. A method as defined in claim 3 wherein the tooling stations are arranged to form an angle of about thirty degrees and two minutes.

5. A method as defined in claim 1 including the step of urging the draw pad at each station towards the corresponding blank and draw die until the corresponding cup is fully drawn between the die center punch and the corresponding blank and draw die.

6. A method as defined in claim 1 and including the step of forming an inwardly projecting boss within the bottom of each cup at each station by moving a bottom panel punch into a cavity within the corresponding die center punch.

7. A method as defined in claim 1 and including the step of sequentially engaging the center portions of the blanks at the stations by the corresponding die center punches for sequentially drawing the blanks into cups to reduce the compressive and tensile loading on the press during each stroke of the inner ram.

8. A method as defined in claim 1 wherein the draw pads at the stations sequentially hold the metal blanks against the corresponding blank and draw dies to reduce the compressive and tensile loading on the press during each stroke of the outer ram.

9. A method as defined in claim 1 wherein the cut edge dies at the stations and the corresponding blank and draw dies sequentially cut the strip into blanks at the stages to reduce the compressive and tensile loading on the press during each stroke of the outer ram.

10. A method of forming a batch of cups from a strip of sheet metal with each stroke of a double action mechanical press including an inner ram and an outer ram each supported for reciprocating movement, the rams supporting tooling comprising a series of two parallel rows of horizontally spaced and substantially identical cup-forming stations each including an annular draw pad, an annular blank and draw die opposing the annular draw pad at each station, an annular cut edge die surrounding the draw pad at each station, and a die center punch within the draw pad at each station, the method comprising the steps of forming the cut edge die and the blank and draw die at each station to produce an out-of-round disk-like blank having a diameter in the direction of feed of the strip through the press less than the diameter in a direction perpendicular to the direction of feed and across the width of the strip, arranging the tooling stations to produce nested blanks with adjacent blanks having centers defining a line forming an angle slightly greater than thirty degrees with a line perpendicular to the direction of feed of the strip through the press, cutting the strip between the annular cut edge dies and the corresponding annular blank and draw dies for forming the blanks, holding the metal blanks between the annular draw pads and the corresponding annular blank and draw dies at the stations, and engaging center portions of the blanks with the corresponding die center punches for drawing the blanks into cups.

11. A method as defined in claim 10 including the step of urging the draw pad at each station towards the corresponding blank and draw die until the corresponding cup is fully drawn between the die center punch and the corresponding blank and draw die.

12. A method as defined in claim 10 and including the step of forming an inwardly projecting boss within the bottom of each cup at each station by moving a bottom panel punch into a cavity within the corresponding die center punch.

13. A method as defined in claim 10 and including the step of sequentially engaging the center portions of the blanks at the stations by the corresponding die center punches for sequentially drawing the blanks into cups to reduce the compressive and tensile loading on the press during each stroke of the inner ram.

14. A method as defined in claim 10 wherein the draw pads at the stations sequentially hold the metal blanks against the corresponding blank and draw dies to reduce the compressive and tensile loading on the press during each stroke of the outer ram.

15. A method as defined in claim 10 wherein the cut edge dies at the stations and the corresponding blank and draw dies sequentially cut the strip into blanks at the stages to reduce the compressive and tensile loading on the press during each stroke of the outer ram.

16. Tooling apparatus for use on a double action mechanical press including an inner ram and an outer ram each supported for reciprocating movement and for substantially simultaneously forming a batch of cups from a strip of sheet metal with reciprocating strokes of the rams, said tooling apparatus comprising a series of horizontally spaced and substantially identical cup-forming stations each having cup-forming tooling components including an annular draw pad connected to move with said outer ram, a corresponding annular blank and draw die opposing each of said draw pads at each of said stations, a corresponding annular cut edge die surrounding each of said draw pads and connected to move with said outer ram, a die center punch within each of said draw pads and connected to move with said inner ram, said tooling stations arranged to position said annular cut edge dies and the corresponding said blank and draw dies to form a series of nested generally circular disk-like blanks with each stroke of said outer ram and with adjacent blanks having centers defining a line forming an angle different than thirty degrees with a line perpendicular to the direction of feed of the strip through the press, the corresponding said blank and draw dies and opposing said draw pads having opposing surfaces cooperating to hold the metal between said draw pads and said blank and draw dies at said stations with each stroke of said outer ram, said die center punches and the corresponding said blank and draw dies at said stations having cooperating surfaces for drawing the blanks into the cups with each stroke of said inner ram, and said cut edge die and said blank and draw die at each said station having a diameter in the direction of feed of the strip through the press less than the diameter in a direction perpendicular to the direction of feed and across the width of the strip.

17. Apparatus as defined in claim 16 wherein said tooling stations are arranged to produce nested blanks with adjacent blanks having centers defining a line forming an angle slightly greater than thirty degrees with a line perpendicular to the direction of feed of the strip through the press.

18. Apparatus as defined in claim 17 wherein the tooling stations are arranged to form an angle of about thirty degrees and two minutes.

19. Apparatus as defined in claim 16 and including means for urging said draw pad at each said station towards the corresponding said blank and draw die until the corresponding cup is fully drawn between said die center punch and the corresponding said blank and draw die.

20. Apparatus as defined in claim 16 wherein each of said die center punches has a cavity opposing a corresponding bottom panel punch for forming an inwardly projecting boss within the bottom of each cup at each said station.

21. Apparatus as defined in claim 16 wherein said die center punches and the corresponding blank and draw dies are positioned for sequentially drawing the blanks into cups at said stations to reduce the compressive and tensile loading on the press during each stroke of the inner ram.

22. Apparatus as defined in claim 16 wherein said draw pads and the corresponding said blank and draw dies are positioned for sequentially holding the metal blanks at said stations to reduce the compressive and tensile loading on the press during each stroke of the outer ram.

23. Apparatus as defined in claim 16 wherein said cut edge dies and the corresponding said blank and draw dies are positioned for sequentially cutting the strip into blanks at said stations to reduce the compressive and tensile loading on the press during each stroke of the outer ram.

* * * * *

UNITED STATES PATENT AND TRADEMARK OFFICE

CERTIFICATE OF CORRECTION

PATENT NO. : 5,802,907

DATED : September 8, 1998

INVENTOR(S) : Ralph P. Stodd

It is certified that error appears in the above-identified patent and that said Letters Patent is hereby corrected as shown below:

Column 1, line 55, delete "raim", insert --ram--.

Column 7, line 39, insert after "effective" --to produce a drawn metal cup C1 from a substantially circular sheet metal blank B1. Each cup C1 includes a cylindrical side wall and a bottom wall--

Signed and Sealed this

Eighth Day of December, 1998

Bruce Lehman

*Attest:*

BRUCE LEHMAN

*Attesting Officer*

*Commissioner of Patents and Trademarks*